US008109186B2

(12) United States Patent
Culling

(10) Patent No.: US 8,109,186 B2
(45) Date of Patent: Feb. 7, 2012

(54) GRIPPING FOOD PRODUCTS IN SLICING MACHINES

(75) Inventor: Alan Culling, Norwich (GB)

(73) Assignee: AEW Delford Systems Limited (GB)

( * ) Notice: Subject to any disclaimer, the term of this patent is extended or adjusted under 35 U.S.C. 154(b) by 385 days.

(21) Appl. No.: 12/027,470

(22) Filed: Feb. 7, 2008

(65) Prior Publication Data

US 2008/0199285 A1 Aug. 21, 2008

(30) Foreign Application Priority Data

Feb. 15, 2007 (GB) ..... 0702949.9

(51) Int. Cl.
*B26D 7/01* (2006.01)

(52) U.S. Cl. ..... 83/151; 83/409; 83/437.2; 83/932; 414/225.01

(58) Field of Classification Search ..... 83/151–154, 83/932, 13, 409, 409.1, 422, 437.1–437.7, 83/703; 414/225.01, 800
See application file for complete search history.

(56) References Cited

U.S. PATENT DOCUMENTS

| | | | | |
|---|---|---|---|---|
| 2,126,421 | A * | 8/1938 | Stukart | 269/54.3 |
| 4,505,468 | A * | 3/1985 | Heisler | 271/18.3 |
| 5,628,237 | A * | 5/1997 | Lindee et al. | 83/403.1 |
| 2004/0055439 | A1 | 3/2004 | Lindee et al. | |

FOREIGN PATENT DOCUMENTS

| | | | |
|---|---|---|---|
| DE | 36 31 992 | * | 3/1988 |
| DE | 39 21 243 | * | 1/1991 |
| DE | 4230574 | * | 3/1994 |
| DE | 4413568 | A1 | 10/1995 |
| GB | 3856 | | 12/1913 |
| GB | 370660 | | 4/1932 |

OTHER PUBLICATIONS

Examination Report in EP 08250461.4 issued Apr. 29, 2010.

* cited by examiner

*Primary Examiner* — Phong Nguyen
(74) *Attorney, Agent, or Firm* — Barnes & Thornburg LLP

(57) ABSTRACT

An apparatus for gripping food products such as bacon, cheese or cooked meat in a slicing machine, together with methods of operation thereof. The gripper apparatus comprises hooks for gripping one end of the food product. During slicing, the slicing machine cuts slices from the other end of the food product. Two sets of hooks are present and each set of hooks is moveable between a retracted inoperative position and an extended product-gripping position, independently of the other set. The second set of hooks, when in their extended position, projects for a distance greater than the first set of hooks. Both sets of hooks occupy their extended positions during initial stages of slicing and the second set of hooks is withdrawn to their retracted position during a final stage of slicing so that more of the remaining end of the product can be sliced. The hooks of the first and second sets are curved and occupy parallel planes when in their extended positions, with the planes occupied by the first set of hooks being orthogonal to the planes occupied by the second set of hooks.

9 Claims, 3 Drawing Sheets

GRIPPING FOOD PRODUCTS IN SLICING MACHINES

FIELD OF THE INVENTION

This invention relates to apparatus for and a method of gripping food products (such as bacon, cheese or cooked meat) in a slicing machine.

BACKGROUND TO THE INVENTION

A known gripper apparatus for use in a food slicing machine comprises a plurality of hooks or teeth which are movable together between an inoperative retracted position and an extended operative position in which the hooks or teeth penetrate and thereby grip the trailing end of a food product, the forward or leading end of which is urged into contact with a slicing blade which slices the product, ready for packaging.

SUMMARY OF THE INVENTION

According to one aspect of the invention there is provided gripper apparatus comprising hooks for gripping one end of a food product in a food slicing machine which slices the other end of the food product, the apparatus comprising a first set of hooks movable between a retracted inoperative position and an extended product-gripping position, a second set of hooks movable between a retracted inoperative position and an extended product-gripping position, the second set of hooks when in their extended position projecting for a distance greater than the first set of hooks when in their extended position and the sets of hooks being independently movable, enabling both sets of hooks to occupy their respective extended positions during an initial stage of slicing and the second set of hooks to be withdrawn to their retracted position during a final stage of slicing so that more of the remaining end of the product can be sliced.

At the commencement of slicing, the food product is bulky and heavy and requires a firm and robust grip, particularly (as is frequently the case) the machine has an inclined bed on which the food product is supported with its upper trailing end gripped by the gripper apparatus. By contrast, at the end of the slicing operation, the food product is greatly diminished in size and weight, negating the need for such a robust grip whilst there remains the desirability of being able to slice the product as far as possible before the slicing blade fouls the hooks or teeth. The invention aims to reconcile these conflicting factors.

When the two sets of hooks are in their respective extended positions, they provide a firm grip, minimising the risk of a product with a "soft" end breaking away and falling into the slicing machine and being lost as a consequence. Also, it may in some circumstances be desirable to retract the product slightly, which again requires a firm grip.

The hooks of the first set are preferably interconnected by a first linkage attached to a first pneumatically operated actuator, and the hooks of the second set are also preferably interconnected by a second linkage attached to a second pneumatically operated actuator.

In the preferred embodiment, the hooks of the first set are curved and occupy parallel planes when in their extended position, and the hooks of the second set are curved and occupy parallel planes when in their extended position, the planes occupied by the first set of hooks being orthogonal to the planes occupied by the second set of hooks. In this preferred embodiment the planes occupied by the first set of hooks are vertical, but the hooks can be of any desired shape and can occupy any desired plane or move in the same or opposite directions. The configuration of the hooks will depend on the nature of the food product. The preferred embodiment is suitable for products such as bacon which have a relatively small vertical dimension.

In the preferred embodiment there are six hooks in the first set and four hooks in the second set, with the hooks of the first set projecting for a distance between 8 and 12 mm (preferably 10 mm) and the hooks of the second set projecting for a distance between 28 and 32 mm (preferably 30 mm).

The invention includes within its scope a slicing machine having a gripper assembly according to the invention and having an inclined surface or bed on which the food product is supported, with the upper end of the product being gripped by the gripper apparatus according to the invention.

According to another aspect of the invention there is provided a method of gripping a food product by means of hooks during slicing of the food product in a slicing machine, the method comprising using both a first set of hooks and a second set of hooks to engage one end of the product during an initial stage of slicing, the second set of hooks penetrating more deeply into the food product than the first set of hooks, and moving the second set of hooks to a retracted withdrawn position during a final stage of slicing so that more of the remaining end of the product can be sliced.

BRIEF DESCRIPTION OF THE DRAWINGS

Gripper apparatus according to the invention will now be described by way of example, with the reference to the accompanying drawings, in which.

DETAILED DESCRIPTION OF THE DRAWINGS

Figure 1:
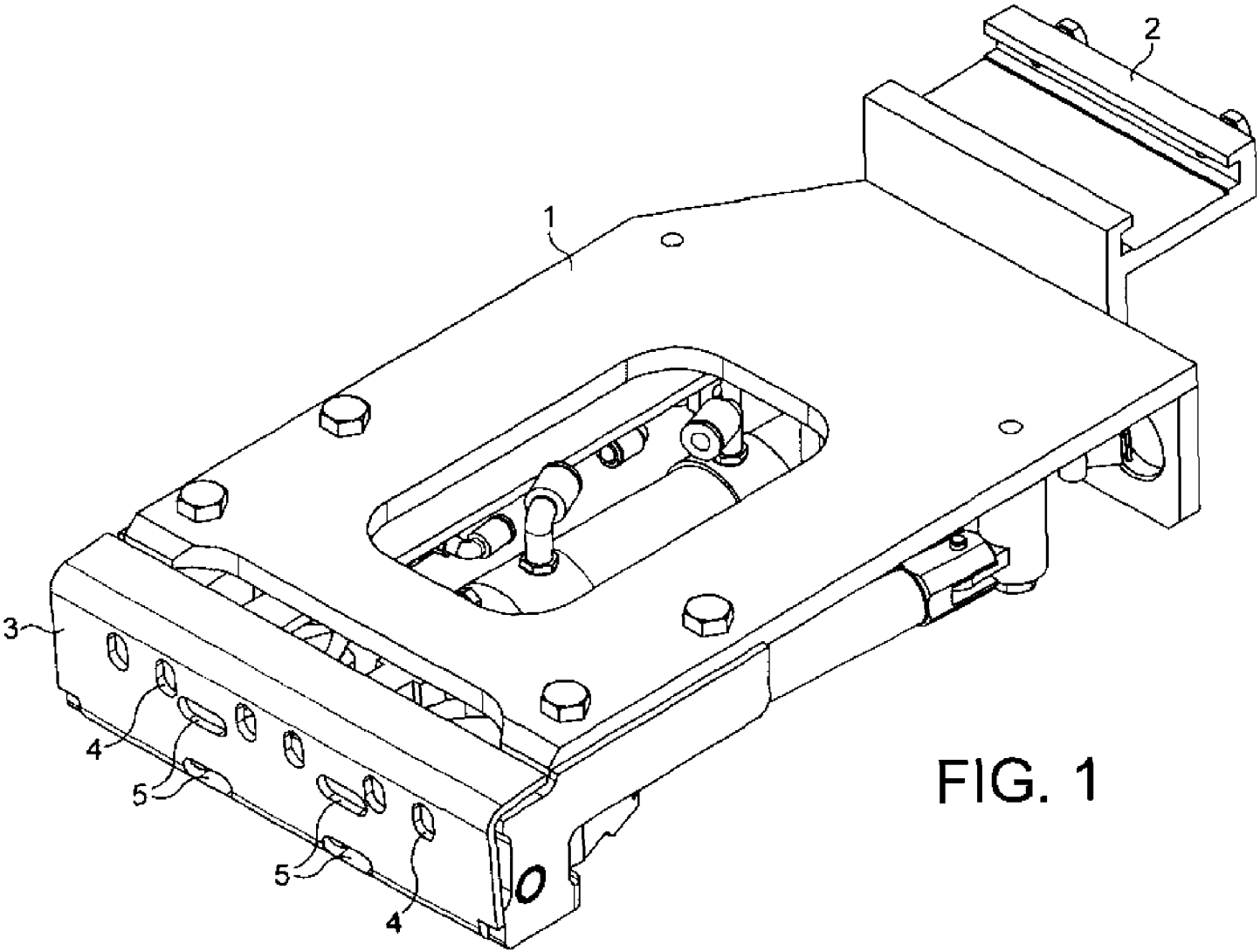
FIG. 1 is an isometric view of the gripper apparatus with two sets of hooks retracted.

The gripper apparatus has a base plate 1 to the rear of which is attached a channel member 2 for mounting the apparatus in a bacon slicing machine and to the front of which is pivotally mounted a sensor plate 3. The sensor plate 3 has a series of six horizontally aligned and horizontally spaced holes 4 and two pairs of slots 5, the two slots 5 of each pair being vertically spaced and the two pairs being horizontally spaced as best seen in FIG. 1.

The gripper apparatus has a first set of six hooks 6 movable between an inoperative retracted position (FIG. 1) and an operative extended position (FIG. 2) in which the six hooks 6 project forwardly through the six holes 4 respectively. The gripper apparatus also has a second set of four hooks 7 movable between an inoperative retracted position (FIG. 1) and an operative extended position (FIG. 2) in which the four hooks 7 project forwardly through the four slots 5.

The six hooks 6 are interconnected by a first linkage which is attached to a first pneumatic actuator. The first actuator operates to move all six hooks 6 between the retracted and extended positions. Similarly, the four hooks 7 are interconnected by a second linkage which is attached to a second pneumatic actuator. The second actuator operates independently of the first actuator and is thereby capable of moving the four hooks 7 between their retracted and extended positions, independently of any movement imparted to the first hooks 6.

Figure 2:
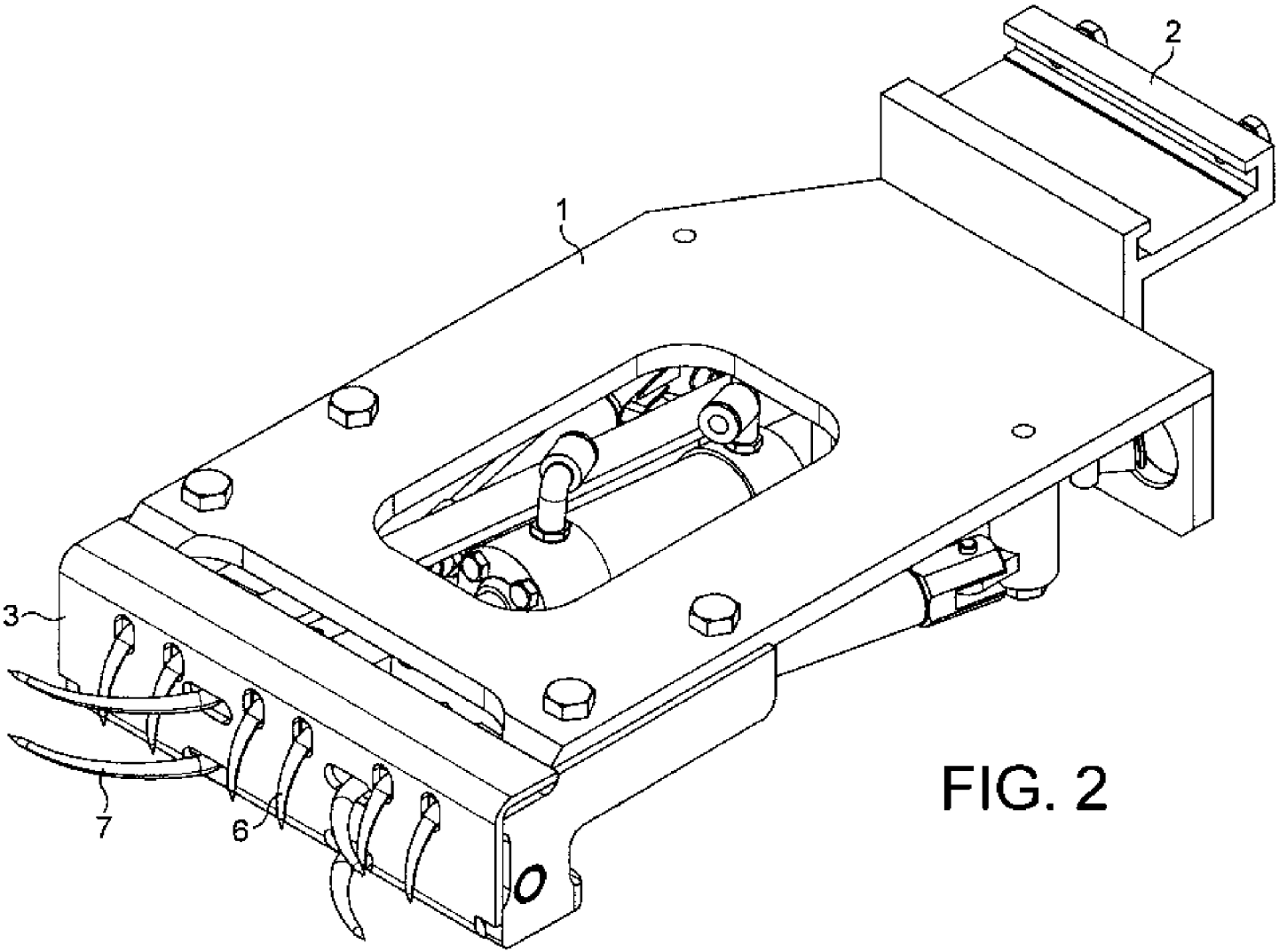
FIG. 2 is a view corresponding to FIG. 1 but with the two sets of hooks extended.

It can be seen from FIG. 2 that the six hooks 6 move downwardly and forwardly of the plate 3 when moving to their extended positions and that the four hooks 7 move horizontally, one pair moving outwardly towards one side of the apparatus and the other pair moving outwardly towards the other side of the apparatus. In their extended positions, the six hooks 6 occupy horizontally spaced vertical planes and the four hooks 7 occupy spaced planes (horizontal when the plate 3 is horizontal) orthogonal to the planes occupied by the hooks 6.

Figure 3:
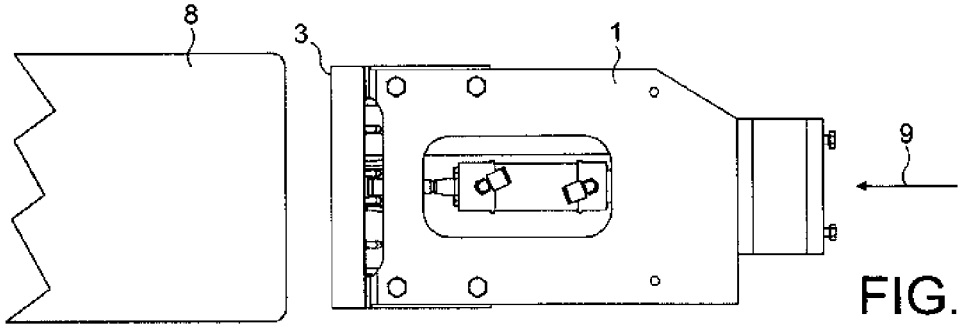
FIGS. 3 to 6 are plan views illustrating the gripper apparatus at four moments in an operative cycle of the gripper apparatus.
Figure 4:
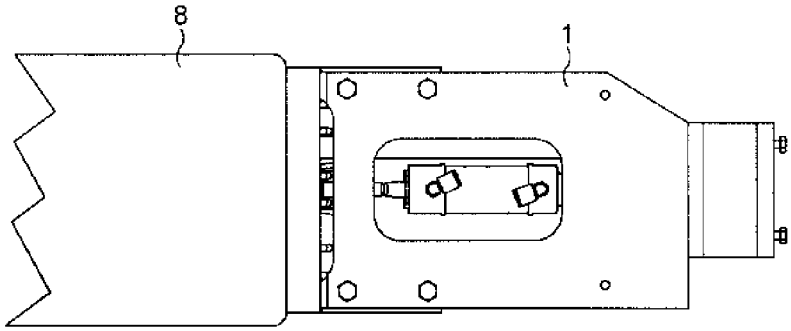
Figure 5:
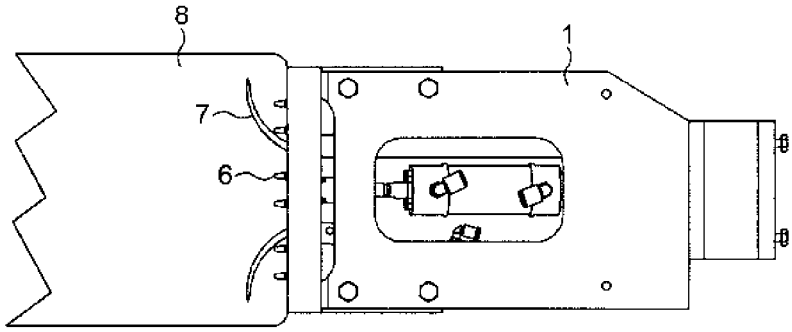

FIGS. 3 to 6 illustrate the gripper apparatus being used to grip a log 8 of food product, such as bacon. FIG. 3 shows the apparatus being moved in the direction of the arrow 9, towards the log 8, with both sets of hooks in their respective retracted positions behind the sensor plate 3. When the apparatus contacts the trailing end of the log (FIG. 4) this engagement displaces the sensor plate 3 which pivots through a small angle. A sensor detects this pivoting movement and causes both pneumatic actuators to be energised, resulting in both sets of hooks 6, 7 being moved to their extended positions. When this happens, both sets of hooks 6, 7 penetrate the trailing end of the log 8, the four hooks 7 penetrating more deeply into the log than the hooks 6. For example, the hooks 7 may penetrate 30 mm into the product and the hooks 6 10 mm. With both sets of hooks 6, 7 engaged, the log 8 is firmly gripped at its trailing end and its forward end is pushed by the gripper apparatus into contact with a spinning slicing blade (not shown). As slicing proceeds, the gripper apparatus moves towards the left, pushing the log 8 towards the slicing blade.

In many forms of bacon slicer, the log to be sliced is supported in an inclined position, with the leading end of the log lower than the trailing end so the firm grip of the two sets of hooks 6, 7 counteracts any tendency for the log 8 to become detached from the gripper apparatus. In some circumstances the log may be retracted slightly, so a firm grip provided by the engagement of the two sets of hooks enables this to be achieved.

Figure 6:
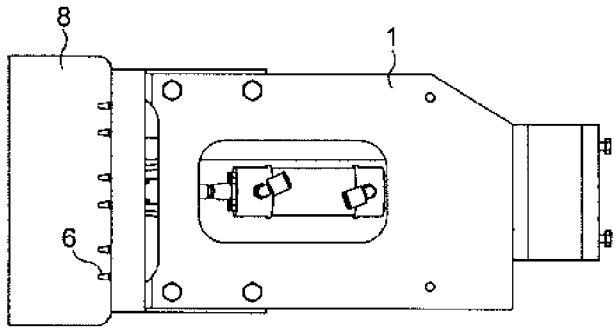

As slicing proceeds, the length and weight of the log are reduced (FIG. 6). When the remaining length of log is small, and at a predetermined point in the length of travel of the gripper apparatus, the second actuator causes the four hooks 7 to move to their retracted positions, leaving the six hooks 6 in their extended positions. As a result, more of the length of the log can be sliced in this final stage of slicing, without the slicing blade fouling any hooks, minimising the length of the butt end of the log which represents wastage. The hooks 6 are then retracted from the butt end of the log.

In the example, an additional 4 mm of food product can be sliced from every food product, in comparison with known machines.

After being sliced, the bacon slices emerge onto a conveyor for packaging and the gripper apparatus undertakes a return stroke (towards the right as viewed in FIGS. 3 to 6) ready to engage the next product to be sliced.

The invention claimed is:

1. Gripper apparatus comprising a gripper body and hooks for gripping one end of a food product located ahead of the gripper apparatus in a food slicing machine which slices the other end of the food product, the apparatus comprising:

a first set of hooks movable relative to the gripper body between a retracted inoperative position and an extended product-gripping position; and a second set of hooks movable relative to the gripper body between a retracted inoperative position and an extended product-gripping position, wherein the second set of hooks when in their extended position projects ahead of and away from the gripper body to a distance greater than the first set of hooks when in their extended position to penetrate into the product to a greater depth measured ahead of and away from the gripper body, the first and second sets of hooks being independently movable relative to the gripper body between their retracted and extended positions, enabling both sets of hooks to occupy their respective extended positions during an initial stage of slicing and the second set of hooks to be withdrawn to their retracted position during a final stage of slicing so that more of the remaining end of the product can be sliced, the first and second sets being curved and occupy parallel planes when in their extended position, the planes occupied by the first set of hooks being orthogonal to the planes occupied by the second set of hooks, and the hooks of the second set being movable outwardly towards opposite sides of the apparatus as they move into their extended product-gripping positions.

2. Gripper apparatus according to claim 1, wherein the hooks of the first set are interconnected by a first linkage attached to a first pneumatically operated actuator, and the hooks of the second set interconnected by a second linkage attached to a second pneumatically operated actuator.

3. Gripper apparatus according to claim 1, wherein the planes occupied by the first set are vertical.

4. Gripper apparatus according to claim 1, wherein there are six hooks in the first set and four hooks in the second set.

5. Gripper apparatus according to claim 1, wherein the first hooks project for a distance between 8 and 12 mm, preferably 10 mm.

6. Gripper apparatus according to claim 1, wherein the second hooks project for a distance between 28 and 32 mm, preferably 30 mm.

7. Gripper apparatus according to claim 1, wherein the apparatus has a sensor plate which senses initial engagement of the apparatus with the trailing end of the food product to cause both sets of hooks to move from their respective retracted positions to their respective extended positions.

8. Gripper apparatus according to claim 1 and in combination with a slicing machine having an inclined bed or surface on which the food product is supported, with the upper end of the product being gripped by the gripper apparatus.

9. Gripper apparatus according to claim 1, wherein one pair of hooks in the second set is movable outwardly towards one side of the apparatus and another pair of hooks in the second set is moveable outwardly towards the other side of the apparatus as they move into their extended positions.

* * * * *